US007703650B2

(12) United States Patent
Haramiishi et al.

(10) Patent No.: US 7,703,650 B2
(45) Date of Patent: Apr. 27, 2010

(54) STAPLE CONTAINER FOR ELECTRIC STAPLER

(75) Inventors: Kiichi Haramiishi, Tokyo (JP); Koji Morii, Tokyo (JP)

(73) Assignee: Max Co., Ltd., Tokyo (JP)

( * ) Notice: Subject to any disclaimer, the term of this patent is extended or adjusted under 35 U.S.C. 154(b) by 0 days.

(21) Appl. No.: 11/665,803

(22) PCT Filed: Sep. 20, 2005

(86) PCT No.: PCT/JP2005/017299

§ 371 (c)(1),
(2), (4) Date: Apr. 19, 2007

(87) PCT Pub. No.: WO2006/043390

PCT Pub. Date: Apr. 27, 2006

(65) Prior Publication Data

US 2008/0083805 A1 Apr. 10, 2008

(30) Foreign Application Priority Data

Oct. 20, 2004 (JP) ..... 2004-306245

(51) Int. Cl.
*B27F 7/31* (2006.01)

(52) U.S. Cl. ..... 227/120; 227/131; 227/136; 227/156; 206/338; 206/340

(58) Field of Classification Search ..... 227/120, 227/131, 136, 156; 206/338, 340
See application file for complete search history.

(56) References Cited

U.S. PATENT DOCUMENTS

| | | | | | |
|---|---|---|---|---|---|
| 4,623,082 | A | * | 11/1986 | Kurosawa | 227/7 |
| 5,501,387 | A | * | 3/1996 | Yoshie | 227/120 |
| 5,560,529 | A | * | 10/1996 | Udagawa et al. | 227/136 |
| 6,899,258 | B2 | * | 5/2005 | Haramiishi | 227/2 |
| D512,289 | S | * | 12/2005 | Miwa et al. | D8/49 |
| D512,889 | S | * | 12/2005 | Miwa et al. | D8/49 |
| 7,353,975 | B2 | * | 4/2008 | Haramiishi et al. | 227/120 |

FOREIGN PATENT DOCUMENTS

| | | |
|---|---|---|
| EP | 0 608 756 A1 | 8/1994 |
| JP | 1-84986 | 6/1989 |
| JP | 2-83 | 1/1990 |
| JP | 2003-53680 | 2/2003 |
| JP | 2004-237446 | 8/2004 |

* cited by examiner

*Primary Examiner*—Rinaldi I. Rada
*Assistant Examiner*—Michelle Lopez
(74) *Attorney, Agent, or Firm*—Drinker Biddle & Reath LLP

(57) ABSTRACT

From top to bottom of an inner wall of a case in which stacked stapled sheets each composed of linear staples connected in parallel are accommodated, horizontal nonreturn projections are successively arranged. A nonreturn lug is attached to a staple pushing plate pushing the staple sheets by a spring, and the nonreturn lug is engaged with the nonreturn projections of the case. The nonreturn lug and the nonreturn projections are shaped to permit a descent of the staple pushing plate and inhibit an ascent thereof. In addition, a height of an apex of each of the nonreturn projections is reduced step-wise or with no step from top to bottom of the inner wall of the case.

5 Claims, 5 Drawing Sheets

STAPLE CONTAINER FOR ELECTRIC STAPLER

TECHNICAL FIELD

The present invention relates to a staple container for refill for an electric stapler, and more particularly to a staple container for an electric stapler with an improved pushing mechanism for staple sheets within a case of the staple container.

BACKGROUND ART

An electric stapler in which stacked staple sheets each composed of linear staples connected in parallel are loaded is used as not only a stand-alone stapler but also incorporated in a copier or post-printing processor.

As a kind of electric stapler, there has been proposed an electric stapler using a staple magazine in which stacked staple sheets are loaded. In this electric stapler, when the staples are used up, an entire magazine is replaced. JP-A-2004-237446 discloses an electric stapler in which for the purpose of resource-saving, a staple for refill is received within a case of plastic paper, and the case is loaded in a staple magazine or an electric stapler body.

The staple for refill proposed in JP-A-2004-237446 is provided with a plate-shaped pushing member for pushing staple sheets within a plastic case from above. When an arm or spring provided in the staple magazine or the electric stapler body depresses the pushing member, the pushing member is brought into elastic contact with an upper face of the staple sheets. Thus, a staple sheet on a lowermost layer is stably fed to a forming-and-driver mechanism.

The staple for refill proposed in JP-A-2004-237446 is accommodated in a plastic case and has a structure in which a plate-shaped pushing member is placed on an upper face of the staple sheets. A depressing means such as a spring for urging the pushing member is provided on a side of the staple magazine or the electric stapler body. Therefore, in a state where the depressing means is not loaded in the staple magazine or electric stapler, pushing of the staple sheets is released so that the staple sheets may move up and down, or fly out from the staple forwarding mouth of the case.

In order to obviate such an inconvenience, in accordance with a related art of this application which is not a prior art, sawtooth nonreturn projections are arranged vertically in parallel on an inner wall of the case and a nonreturn lug engaged with the nonreturn projections are provided on a plate-shaped pushing member so that a rise of the plate-shaped pushing member is limited. In accordance with this related art, a component such as a spring is not required so that the structure is simple. In addition, since the metallic component is not used, disposal processing can be easily carried out.

However, in this case, since depressing of the plate-shaped pushing member while the electric stapler is used is entrusted to a spring on a side of a staple magazine or a stapler body, as the staple sheets are consumed and the plate-shaped pushing member descends, a load of the spring decreases so that an elastic force of the spring is problematically reduced.

Specifically, as a result that the spring on the electric stapler depresses the plate-shaped pushing member, when the nonreturn lug of the plate-shaped pushing member warps and climbs over the nonreturn projections, a certain load is applied. If the plate-shaped pushing member is located at a relatively raised position (when there are many remainders of the staple sheets), the spring is compressed to provide a large elastic force so that depressing of the plate-shaped pushing member is not problematic. However, as the plate-shaped pushing member descends owing to consumption of the staple sheets, the spring is expanded and so its elastic force is also reduced. In this case, the nonreturn lug of the plate-shaped pushing member cannot climb over the nonreturn projections so that the plate-shaped pushing member may not be in pressure-contact with the staple sheets.

DISCLOSURE OF THE INVENTION

One or more embodiments of the present invention provide a staple container for an electric stapler, capable of stably holding staple sheets within a case.

In accordance with one or more embodiments of the present invention, a staple container for an electric stapler is provided with: a case for accommodating stacked staple sheets each composed of linear staples connected in parallel; a staple pushing plate which is engaged in the case and is vertically movable; a nonreturn lug provided at an edge of the staple pushing plate; and a plurality of nonreturn projections which are formed on an inner wall of the case and are to be engaged with the nonreturn lug. The height of the nonreturn projections is lowered step-wise or with no step from top to bottom of the inner wall of the case.

Further, in accordance with one or more embodiments of the present invention, each of the nonreturn projections is composed of a horizontal plane extending perpendicularly from a vertical wall toward its apex and an inclined plane extending aslant-upward from the apex toward the vertical wall.

Further, in accordance with one or more embodiments of the present invention, the nonreturn lug is upward in its tip.

Further, in accordance with one or more embodiments of the present invention, the staple container for an electric stapler is further provided with: a guide shaft which projects outwardly from a side of the staple pushing plate; a guide groove formed on a side wall of the case, the guide groove being engaged with the guide shaft to guide the staple pushing plate; and a rear wall supported by the case so that its upper end is pivotable, wherein the guide groove is composed of a vertical groove portion extending vertically and a horizontal groove portion extending horizontally from the end of the vertical groove portion; and the rear wall has an engagement portion to be engaged with the side of a container accommodating chamber.

In accordance with one or more embodiments of the present invention, when the staple pushing plate reaches the bottom of the staple container, the guide groove guides the staple pushing plate forward; when the case is loaded in the container accommodating chamber, the engagement portion is engaged with the side of the container accommodating chamber and when the staple pushing plate moves forward, pivoting of the rear wall is permitted, thereby releasing engagement of the engagement portion.

In accordance with one or more embodiments of the present invention, in a staple container, on the inner wall of the case in which stacked stapled sheets each composed of linear staples are loaded, nonreturn projections are provided. A nonreturn lug is attached to the staple pushing plate for holding down the upper face of the staple sheets within the case using a spring. The nonreturn lug is engaged with the nonreturn projections to inhibit the ascent of the staple pushing plate. In addition, the height of the apex of the nonreturn projection is lowered from top to bottom. Thus, as the staple pushing plate descends, the descending driving load of the staple pushing plate is reduced. As a result, even if the elastic force of the spring which depresses the staple pushing plate is reduced, the staple pushing plate can be surely lowered to the bottom of the case, thereby holding the staple sheets within the case.

Further, in accordance with one or more embodiments of the present invention, when the staple pushing plate reaches the bottom of the staple container, the staple pushing plate is slid forward; when the case is loaded in the container accommodating chamber, the engagement portion is engaged with the side of the container accommodating chamber; and when the staple pushing plate moves forward, pivoting of the rear wall is permitted, thereby releasing engagement of the engagement portion. Therefore, if the staple sheets remain within the case, the staple container cannot be removed from the container accommodating chamber. On the other hand, if no staple sheets remain within the case, the staple container can be removed from the container accommodating chamber. As a result, it is possible to prevent the staple container from being erroneously removed although the staple sheets remain.

Other aspects and advantages of the invention will be apparent from the following description and the appended claims.

DESCRIPTION OF REFERENCE NUMERALS AND SIGNS

Figure 1:
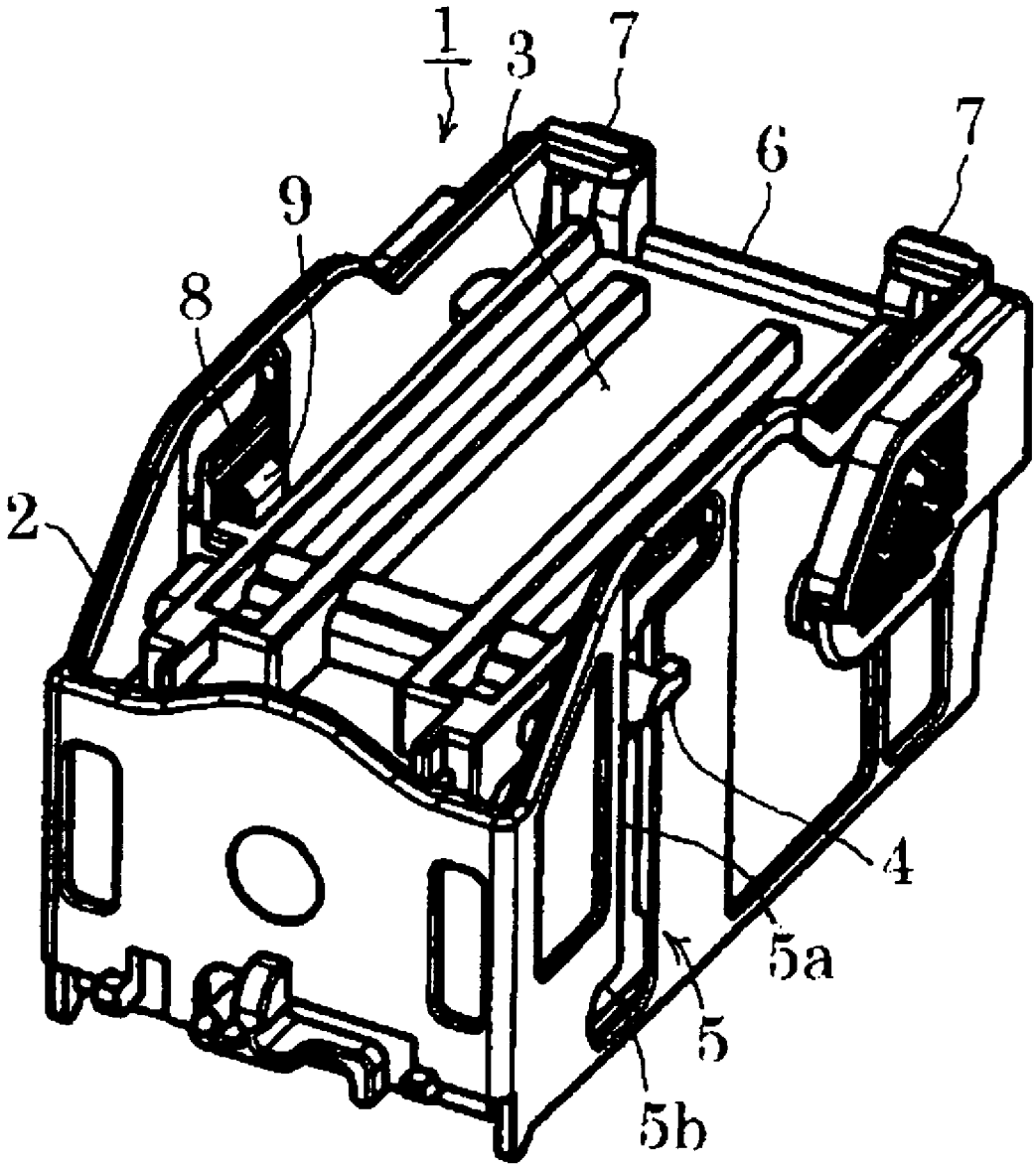
FIG. 1 is a perspective view of a staple container for refill.

1 staple container
2 case
3 staple pushing plate
4 guide shaft
5 guide groove
6 rear wall
7 hinge
8 nonreturn projection
8*a* upper half
8*b* lower half
9 nonreturn lug

BEST MODE FOR CARRYING OUT THE INVENTION

Referring to the drawings, an explanation will be given of one or more embodiments of the present invention.

Embodiment 1

FIG. 1 to FIG. 3E illustrate a staple container 1. Within a square case 2 with an upper face opened, a staple pushing plate 3 is loaded so as to overlie an upper face of stacked staple sheets S.

Figure 2A:
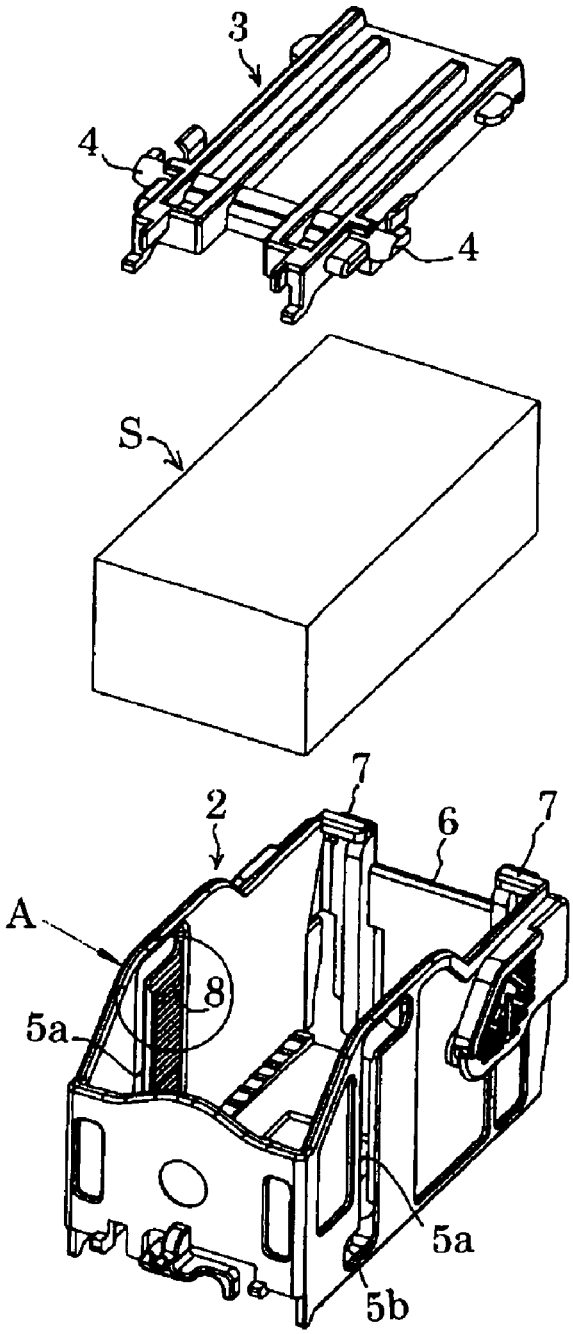
FIG. 2A is an assembling view of a staple container in FIG. 1.

As shown in FIG. 2A, the staple pushing plate 3 has a guide shaft 4 which projects outwardly from both right and left sides at its front. On right and left side walls of the case 2, vertical guide grooves 5 in which the guide shaft 4 of the staple pushing plate 3 is engaged are formed. The guide groove 5 horizontally bends at both upper and lower ends of a vertical groove portion 5*a*. Thus, when the staple pushing plate 3 descends along the guide grooves 5 to reach the bottom of the case 2, the staple pushing plate 3 can be slid forward along the horizontal groove portions 5*b* of the guide grooves 5.

Figure 3A:
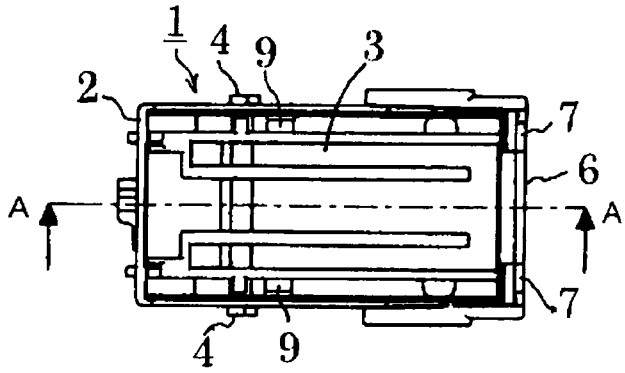
FIG. 3A is a plan view of the staple container in FIG. 1.
Figure 3B:
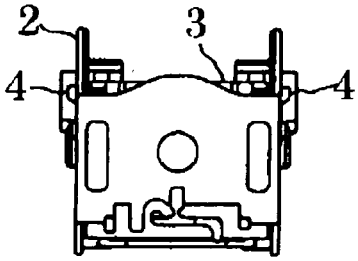
FIG. 3B is a front view of the staple container in FIG. 1.
Figure 3C:
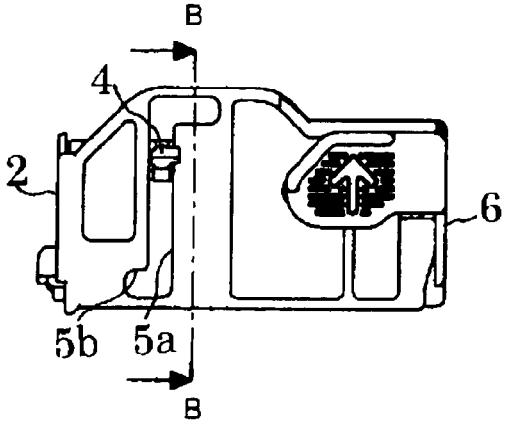
FIG. 3C is a side view of the staple container in FIG. 1.
Figure 3D:
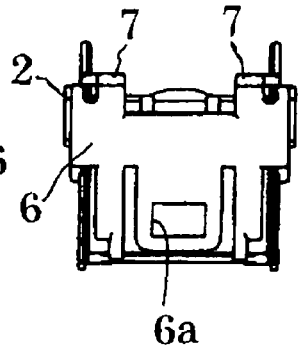
FIG. 3D is a rear view of the staple container in FIG. 1.
Figure 3E:
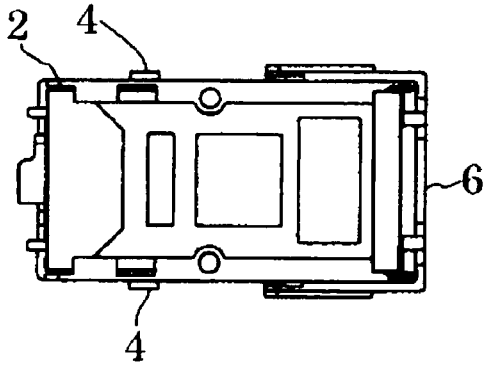
FIG. 3E is a bottom view of the staple container in FIG. 1.
Figure 4A:
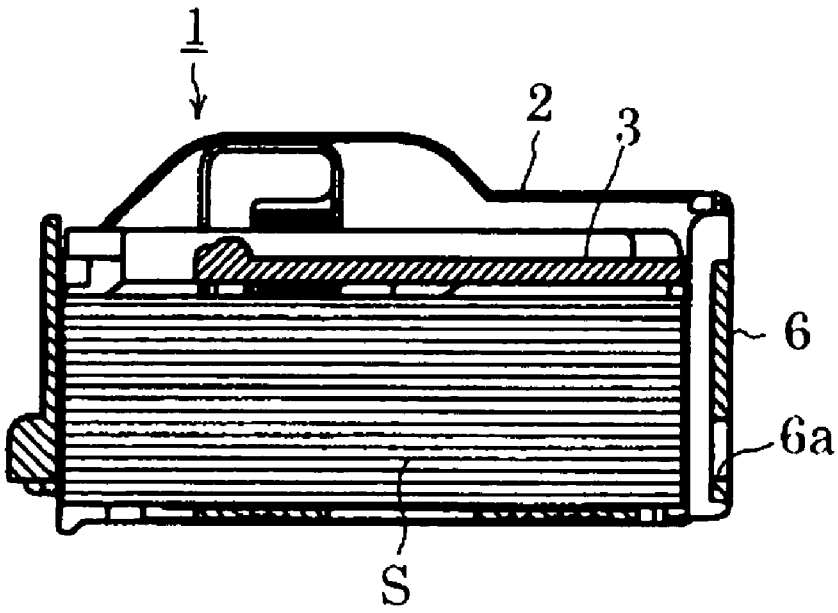
FIG. 4A is a sectional view of line A-A in FIG. 3A.
Figure 4B:
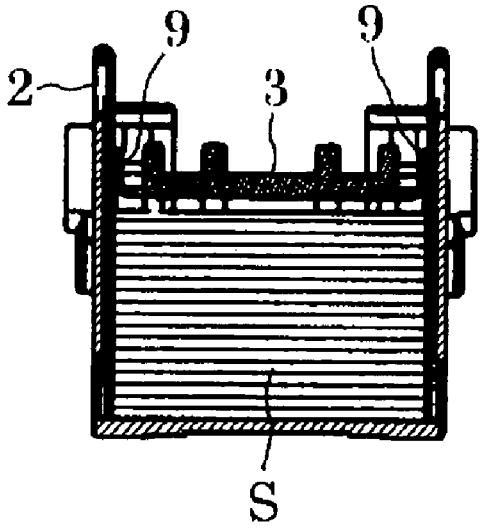
FIG. 4B is a sectional view of line B-B in FIG. 3C.

A rear wall 6 of the case 2 is coupled with the case 2 through thin hinges 7 at the upper end. By pushing the rear wall 6 from back, the rear wall 6 can be pivoted forward. As shown in FIG. 3D, the rear wall 6 has a square slot 6*a* (engagement portion 6*a*). Thus, when the staple container 1 is loaded in a case accommodating chamber of an electric stapler body or staple cartridge, a locking lug of an electric stapler or a stapler cartridge is engaged in the square slot 6*a* of the rear wall 6, thereby fixing the staple container 1.

As shown in FIGS. 3A to 4B, when the staple sheets S reside within the case 2 so that the guide shaft 4 of the staple pushing shaft 3 is engaged in the vertical groove portions 5*a* of the guide groove 5, the rear end of the staple pushing plate 3 is located immediately before the rear wall 6 so that the rear wall 6 cannot be swung forward. In this way, where the staple sheets S reside with the case 2, the rear wall 6 cannot be pressed so that the staple container 1 cannot be removed from the electric stapler body or staple cartridge.

Further, when the staple sheets S within the case 2 are used up so that the staple pushing plate 3 reaches the bottom of the case 2, the guide shaft 4 enters the horizontal groove portions 5*b* at the end of the guide grooves 5. Thus, the staple pushing plate 3 is movable forward. At this time, by pushing the rear wall 6, the engagement between the square slot 6*a* of the rear wall 6 and the locking lug of the stapler body can be released. So, the staple container 1 can be removed from the electric stapler body or staple cartridge.

Figure 2B:
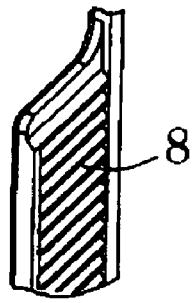
FIG. 2B is an enlarged view of area A in FIG. 2A.

As shown in FIGS. 2A and 2B, on each of the right and left inner walls of the case 2, in parallel to the vertical groove portion 5*a* of the guide groove 5, a plurality of nonreturn projections 8 each having a sawtooth section are formed. Each of the nonreturn projections 8 is composed of a horizontal plane extending perpendicularly from the vertical wall toward an apex and an inclined plane extending aslant-upward from the apex toward the vertical wall. At the right and left edges of the staple pushing plate 3, nonreturn lugs 9 corresponding to each of the nonreturn projections 8 are provided. Since the case 2 and the staple pushing 3 are made of elastic resin, the nonreturn lugs 9 of the staple pushing plate 3 warp according to load. Thus, by applying pressure from above to the staple pushing plate 3 through the spring attached to the electric stapler body or staple cartridge, the staple pushing plate 3 can be lowered.

Figure 5:
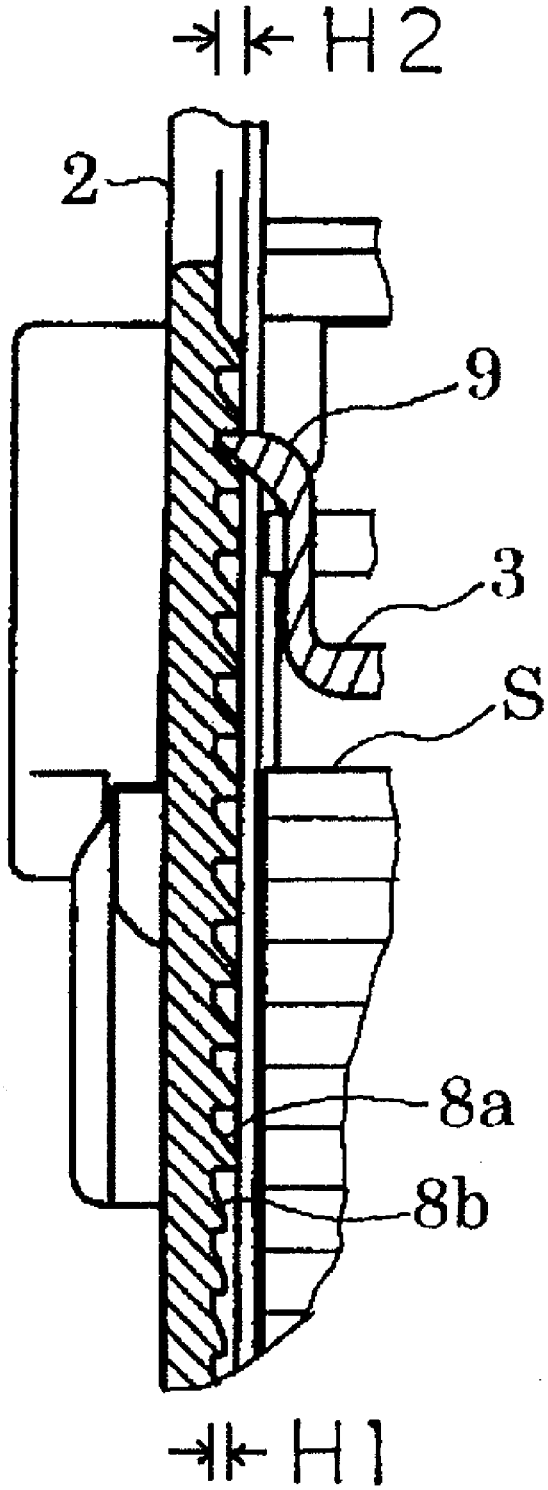
FIG. 5 is an enlarged view of nonreturn projections and nonreturn lug of a staple container.

FIG. 5 is an enlarged view of the nonreturn projections 8 and the nonreturn lug 9. Since the tip of the nonreturn lug 9 of the staple pushing plate 3 is upward oriented, the nonreturn lug 9 easily climbs over the nonreturn lug 8 to descend. However, when external force in a rising direction is applied to the staple pushing plate 3, the nonreturn lug 9 is engaged in the horizontal plane of the nonreturn projection 8 so that the staple pushing plate 3 cannot be raised.

The nonreturn projections 8 formed from the upper portion to the lower portion of the case 2 has the heights different between the upper half 8*a* and the lower half 8*b* thereof. Namely, the height H1 of the apex is lower at the lower half 8*b* than the height H2 of the apex at the upper half 8*a*. Thus, the force required to warp the nonreturn lug 9 so that it descends along the nonreturn projections 8 is made lower at the lower half 8*b* than at the upper half 8*a*.

As the staple sheets are consumed so that the staple pushing plate 3 descends, the load of the spring is gradually reduced to lower the elastic force. Thus, the force of the spring to depress the staple pushing plate 3 is reduced. However, since the height of the nonreturn projection 8 at the lower half 8*b* is lower, the staple pushing plate 3 can be surely depressed regardless of reduction in the elastic force.

Additionally, in the above example, although the height of the nonreturn projections was changed in two steps, it may be changed in more steps. Otherwise, the nonreturn projections may be formed so that their height is changed with no step from top to bottom.

The present invention has been explained in detail and with reference to the specific embodiment. However, it is apparent for those skilled in the art that the present invention can be changed or modified in various manners without departing from the spirit and scope of the invention.

This application is based on Japanese Patent Application (Patent Application No. 2004-306245) filed on Oct. 20, 2004, and the contents of which are hereby incorporated by reference.

INDUSTRIAL APPLICABILITY

From top to bottom of the inner walls of the case in which stacked stapled sheets each composed of linear staples connected in parallel are accommodated, horizontal nonreturn projections are successively arranged. A nonreturn lug attached to the staple pushing plate placed on the upper face of the staple sheets is engaged with the nonreturn projections of the case. The nonreturn lug and the nonreturn projections are shaped to permit the descent of the staple pushing plate and inhibit the ascent thereof. In addition, the height of the apex of each the nonreturn projections is reduced step-wise or with no step from the top to bottom of the inner wall of the case.

As the staple pushing plate descends owing to consumption of the staple sheets within the case, the descending driving load of the staple pushing plate is reduced so that the staple pushing plate depressed by the spring can be surely lowered to the bottom of the case.

The invention claimed is:

1. A staple container for an electric stapler comprising:

a case for accommodating stacked staple sheets each comprising linear staples connected in parallel;

a staple pushing plate engaged in the case and vertically movable;

a nonreturn lug provided at an edge of the staple pushing plate; and a plurality of nonreturn projections formed on an inner wall of the case and engaged with the nonreturn lug, wherein the inner wall of the case includes an upper half and a lower half, the nonreturn projections formed on the lower half of the inner wall project laterally inward from the inner wall by a first height, the nonreturn projections formed on the upper half of the inner wall project laterally inward from the inner wall by a second height, and the second height is greater than the first height, and wherein a force that descends the staple pushing plate along the nonreturn projections is lower at the lower half of the inner wall than at the upper half of the inner wall.

2. The staple container for an electric stapler according to claim 1, wherein each of the nonreturn projections comprises a horizontal plane extending perpendicularly from a vertical wall toward its apex and an inclined plane extending aslant-upward from the apex toward the vertical wall.

3. The staple container for an electric stapler according to claim 1, wherein a tip of the nonreturn lug is upward oriented.

4. The staple container for an electric stapler according to claim 1, further comprising:

a guide shaft projecting outwardly from a side of the staple pushing plate;

a guide groove formed on a side wall of the case, the guide groove being engaged with the guide shaft to guide the staple pushing plate; and a rear wall supported by the case so that its upper end is pivotable, wherein the guide groove comprises a vertical groove portion extending vertically and a horizontal groove portion extending horizontally from an end of the vertical groove portion; and the rear wall comprises an engagement portion to be engaged with a side of a container accommodating chamber.

5. The staple container for an electric stapler according to claim 4, wherein the guide groove is configured to guide the staple pushing plate forward, when the staple pushing plate reaches a bottom of the staple container;

the engagement portion is engaged with the side of the container accommodating chamber, when the case is loaded in the container accommodating chamber, and by a movement of the staple pushing plate in a forward direction, the rear wall is configured to pivot so as to release an engagement of the engagement portion.

* * * * *